US006276154B1

(12) United States Patent
Pippin

(10) Patent No.: US 6,276,154 B1
(45) Date of Patent: Aug. 21, 2001

(54) TWO STEP METERING DEVICE

(75) Inventor: Larry Pippin, Bristol, VA (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

(21) Appl. No.: 09/497,724

(22) Filed: Feb. 4, 2000

(51) Int. Cl.[7] ..... F25B 41/04

(52) U.S. Cl. ..... 62/217; 62/211; 417/300; 417/302

(58) Field of Search ..... 62/210, 211, 217, 62/222, 223; 417/302, 279, 213, 300

(56) References Cited

U.S. PATENT DOCUMENTS

| | | | | |
|---|---|---|---|---|
| 2,543,455 | | 2/1951 | Goepfrich . | |
| 4,009,592 | | 3/1977 | Boerger . | |
| 4,425,767 | | 1/1984 | Barbier . | |
| 4,429,708 | * | 2/1984 | Strueh | 417/300 |
| 4,459,819 | | 7/1984 | Hargraves . | |
| 4,951,478 | | 8/1990 | McDonald . | |
| 5,020,774 | | 6/1991 | Christianson . | |
| 5,318,407 | * | 6/1994 | Davis | 417/300 |
| 5,364,066 | | 11/1994 | Dorste et al. . | |
| 5,405,248 | * | 4/1995 | Alschweig et al. | 417/300 |
| 5,540,566 | * | 7/1996 | Ishizaki et al. | 417/300 |
| 5,715,704 | | 2/1998 | Cholkeri et al. . | |

* cited by examiner

*Primary Examiner*—Michael Powell Buiz
*Assistant Examiner*—Mohammad M Ali
(74) *Attorney, Agent, or Firm*—Finnegan, Henderson, Farabow, Garrett & Dunner, L.L.P.

(57) ABSTRACT

A two-step metering device for controlling the flow of an operating fluid to a variable capacity compressor is provided. The metering device includes a valve that defines a fluid flow path having a large orifice configured to allow a flow rate corresponding to a high operating capacity of the compressor and a small orifice configured to allow a flow rate corresponding to a reduced operating capacity of the compressor. The metering device further includes a control operable to adjust the valve to direct the operating fluid through the large orifice when the compressor is operating at the high capacity and to direct fluid through the small orifice when the compressor is operating at the reduced capacity.

23 Claims, 6 Drawing Sheets

TWO STEP METERING DEVICE

BACKGROUND OF THE INVENTION

The present invention relates generally to fluid flow control devices. More particularly, the present invention relates to a two-step metering device for a variable capacity compressor.

Systems for conditioning air, such as, for example, HVAC systems, air conditioning systems, heat pumps, refrigerators, and freezers may include a variable capacity compressor that is designed to operate at two or more capacities. In this type of conditioning system, the operating capacity of the compressor is varied between a high capacity and a low capacity depending on the operating conditions for the system. Matching the operating capacity of the compressor with the operating conditions can improve the overall efficiency of the conditioning system.

The operating capacity of the compressor may be based on many different operating conditions for the system, including, for example, the conditioning demands of the space being conditioned. The compressor of a refrigerator, for instance, may be operated at full capacity to meet a high demand generated by the introduction of a load of relatively warm items into the cabinet of the refrigerator. The temperature of the cabinet will increase accordingly. This places a greater demand on the cooling system to return the temperature of the cabinet to an acceptable degree. In this situation, the compressor may be run at high capacity to meet the increased demand. When the temperature has been reduced to an acceptable level, the compressor may be operated at a reduced capacity to maintain the desired temperature.

The overall efficiency of a conditioning system is determined by comparing the energy put into the compressor to the amount of heat transferred from the conditioned space. As is known in the art, the greatest efficiency of a conditioning system is achieved when the compressor pressurizes an operating fluid to a predetermined pressure to take advantage of the thermodynamic characteristics of the particular operating fluid. If the compressor is operated at a reduced capacity, the compressor may either pressurize a smaller amount of fluid to the predetermined level or pressurize the same amount of fluid to a reduced level. The most efficient solution is to pressurize a smaller amount of fluid to the predetermined level to take advantage of the thermodynamic characteristics of the operating fluid.

Conditioning systems must also include an expansion valve to reduce the pressure of the operating fluid and allow the operating fluid to expand prior to transferring the heat of the refrigerant and returning to the compressor. There are known expansion valves that are capable of regulating the flow of operating fluid through a conditioning system based on the pressure and/or temperature of the operating fluid. Typically, these valves include a spring-loaded plug disposed adjacent an orifice. The pressurized operating fluid exerts a force on the plug to compress the spring and reveal the orifice. The force of the spring is selected to ensure that the operating fluid has a certain pressure before opening to reveal the orifice. However, these valves are often expensive to manufacture and are often not compatible with the varying demands of a variable capacity compressor.

In light of the foregoing there is a need for a metering device for a variable capacity compressor that is inexpensive and provides a controlled regulation of fluid flow based on the operating capacity of the compressor.

SUMMARY OF THE INVENTION

Accordingly, the present invention is directed to a two-step metering device for a variable capacity compressor. The metering device provides two fluid flow rates that correspond to two operating capacities of the compressor. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a metering device for controlling the flow of an operating fluid to a variable capacity compressor that is operable at a high capacity and a reduced capacity. The metering device includes a valve defining a fluid flow path for controlling the flow rate of the operating fluid to the compressor. The fluid flow path includes a large orifice configured to allow a flow rate of operating fluid that corresponds to the high capacity of the compressor and a small orifice configured to allow a flow rate of operating fluid that corresponds to the reduced capacity of the compressor. A control is provided to adjust the valve to direct the operating fluid through the large orifice when the compressor is operating at the high capacity and to direct fluid through the small orifice when the compressor is operating at the reduced capacity.

In another aspect, the invention is directed to a system for conditioning air in a space. The system includes a sensor that operates to sense the condition of the space and a compressor that operates to compress an operating fluid at a high capacity and a reduced capacity. A valve is provided for controlling the flow of the operating fluid to the compressor. The valve includes a large orifice configured to allow a flow rate of operating fluid corresponding to the high capacity of the compressor and a small orifice configured to allow a flow rate of operating fluid corresponding to the reduced capacity of the compressor. There is further provided a control operable to run the compressor at one of the first and second operating capacities depending upon the sensed condition of the space. The control is further operable to adjust the valve to direct the operating fluid through the large orifice when the compressor is operating at the high capacity and to direct fluid through the small orifice when the compressor is operating at the reduced capacity.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to embodiments of the present invention, examples of which are illustrated in the accompanying drawings. Wherever possible, the same reference numbers will be used throughout the drawings to refer to the same or like parts.

In accordance with the present invention, a metering device for controlling the flow of an operating fluid to a variable capacity compressor is provided. In the illustrated embodiment, the variable capacity compressor is a two-stage reciprocating compressor that operates at a preselected, constant high capacity and a preselected, constant reduced capacity to meet varying demands. The present invention contemplates, however, that the variable capacity compressor may be another type of variable capacity compressor, such as a rotary, screw, or scroll compressor. An exemplary embodiment of a variable capacity compressor consistent with the present invention is illustrated in FIG. 1 and is generally designated by the reference number 20.

Figure 1:
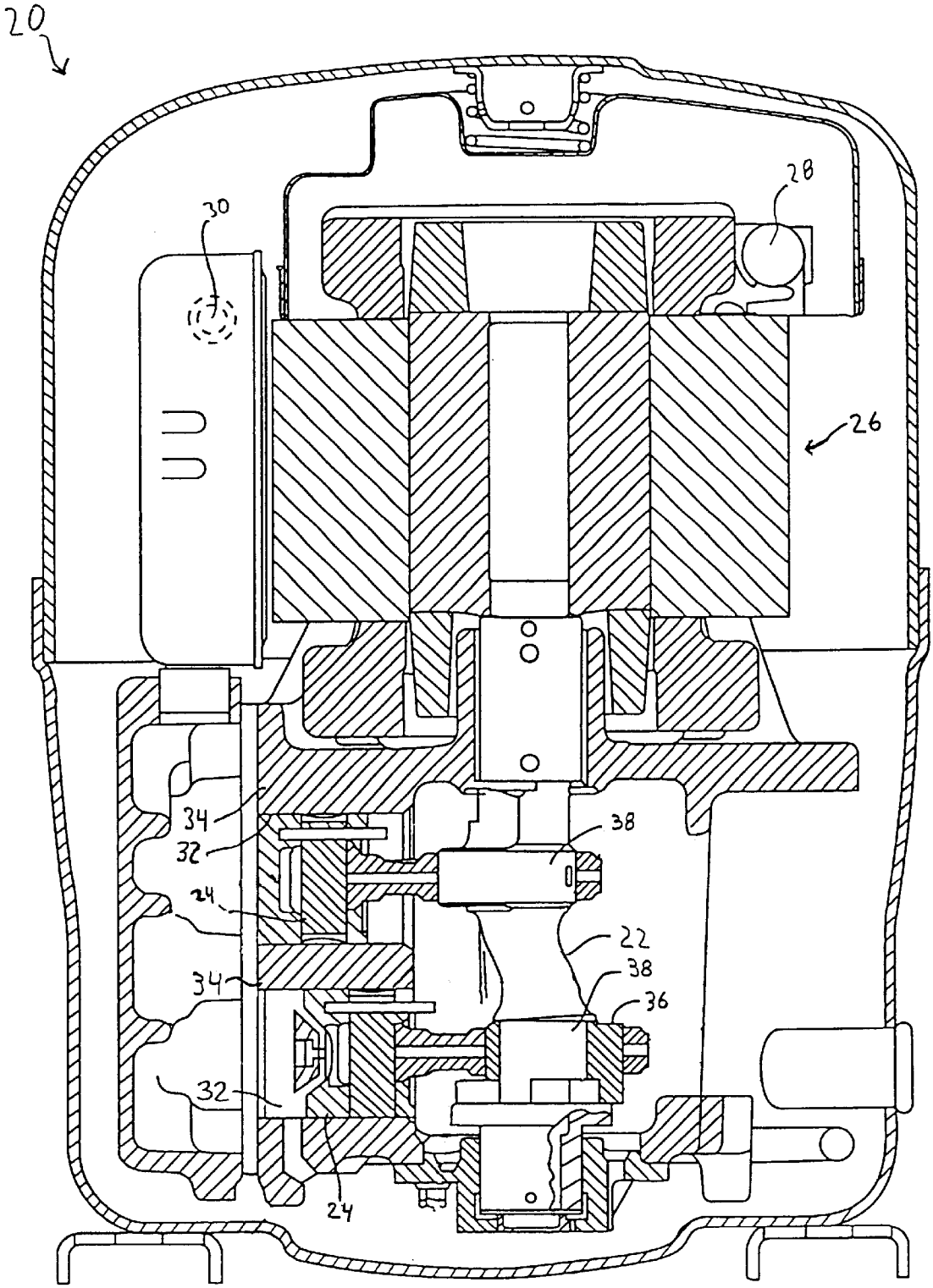
FIG. 1 is a cross-sectional view of a variable capacity compressor.

As illustrated in FIG. 1, compressor 20 includes a crankshaft 22 that drives pistons 24. Pistons 24 are disposed in a compressor block 34 so as to form compression chambers 32. Rotation of crankshaft 22 causes pistons 24 to reciprocate through a stroke within compression chambers 32.

Figure 2:
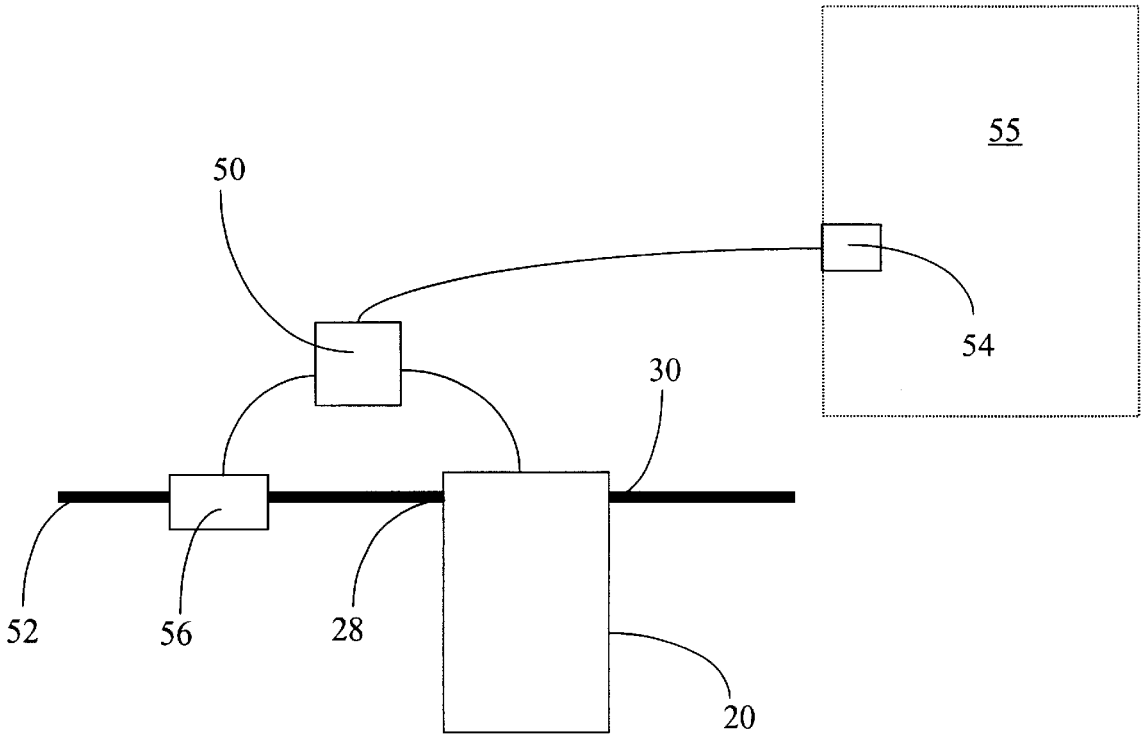
FIG. 2 is a schematic diagram illustrating a control system according to the present invention.

Compressor 20 also includes a motor 26 that rotates crankshaft 22 to drive the pistons. Preferably, motor 26 is a reversible motor capable of rotating the crankshaft in a forward direction and a reverse direction. In addition, as illustrated in FIG. 2, a control is provided to govern the rotational direction of crankshaft 22. Control 50 may also control any other operational features of compressor 20. An exemplary embodiment of a control for a variable capacity compressor is described in pending U.S. patent application Ser. No. 09/014,752, the disclosure of which is hereby incorporated by reference in its entirety.

Control 50 is preferably connected to a sensor 54. Preferably, sensor 54 is disposed in a space 55 to be conditioned by operation of the system containing compressor 20. The space to be conditioned may be any space typically conditioned by a heat pump, air conditioner, or HVAC unit, including, but not limited to, rooms, buildings, refrigerators, or freezers. The present invention contemplates that multiple sensors may be disposed in multiple locations within a room or building and that one or more compressors may be combined to provide conditioning to the room or building.

Sensor 54 senses the condition of the space and sends a signal to control 50 that is representative of the conditions within the space. The sensed conditions of the space may include, for example, the temperature or humidity of the space. Preferably, the sensor is a temperature sensor and may be of any variety readily apparent to one skilled in the art. The present invention contemplates that additional sensors (not shown) may provide input to control 50. These additional sensors may sense other conditions relevant to the operating cycle, such as the outdoor air temperature.

The present invention contemplates that the temperature sensor may be combined with the control in a thermostat. Preferably, the thermostat is programmable so that a user may input the desired temperature or temperature range of the space to be conditioned. The thermostat would control the operating capacity of the compressor, based on the user-input parameters, to achieve the optimum efficiency of the compressor and effect the desired temperature within the space.

Alternatively, in a system where multiple areas are being conditioned by a single compressor, a programmable thermostat may be positioned in each separate area. In this embodiment, the control would be centralized and would receive input from each thermostat that indicates the conditioning needs of the respective area. The central control would control the operating capacity of the compressor based on the combined input from each thermostat.

As illustrated in FIG. 1, crankshaft 22 includes eccentric pins 38. Each piston 24 is connected to the corresponding eccentric pin 38 on crankshaft 22 with an eccentric cam 36. Each cam 36 is rotatably mounted on the corresponding eccentric pin 38 so that when crankshaft 22 is rotated in the forward direction, the eccentricities of the eccentric pins 38 align with the eccentricities of cams 36 to drive the pistons at their full stroke, to thereby run the compressor at the high operating capacity. Reversing the rotational direction of the shaft causes cams 36 to rotate on crankshaft 22 with respect to eccentric pins 38 so that the eccentricities of the cams and the pins are offset and the pistons are driven at a reduced stroke, to thereby run the compressor at a lower capacity. Two-stage variable capacity compressors of this nature are disclosed in U.S. Pat. Nos. 4,479,419; 4,236,874; 4,494,447; 4,245,966; and 4,248,053, and in currently pending U.S. patent application Ser. No. 08/911,348, the disclosures of which are hereby incorporated by reference in their entirety.

Compressor 20 includes an operating fluid inlet 28 and an operating fluid outlet 30. A first line (not shown) connects operating fluid inlet 28 with compression chambers 32 and a second line (not shown) connects compression chambers 32 with operating fluid outlet 30. When the motor rotates the crankshaft to drive the pistons through their reciprocating movement in compression chambers 32, the motion of the pistons draws operating fluid into compression chambers 32. The pistons then compress the operating fluid and force the operating fluid through the operating fluid outlet 30.

In accordance with the present invention, a valve is provided to control the flow of operating fluid to the compressor. The valve defines a flow path that includes a large orifice and a small orifice. The large orifice is configured to allow a flow rate of fluid that corresponds to the high capacity of the compressor and the small orifice is configured to allow a flow rate of fluid corresponding to the reduced capacity of fluid. Metering the flow rate of fluid with the large and small orifices ensures that the compressor will compress the operating fluid to an optimal pressure at both the high and reduced operating capacities. The optimal pressure of the operating fluid depends on the thermodynamic properties of the particular operating fluid.

Figure 3:
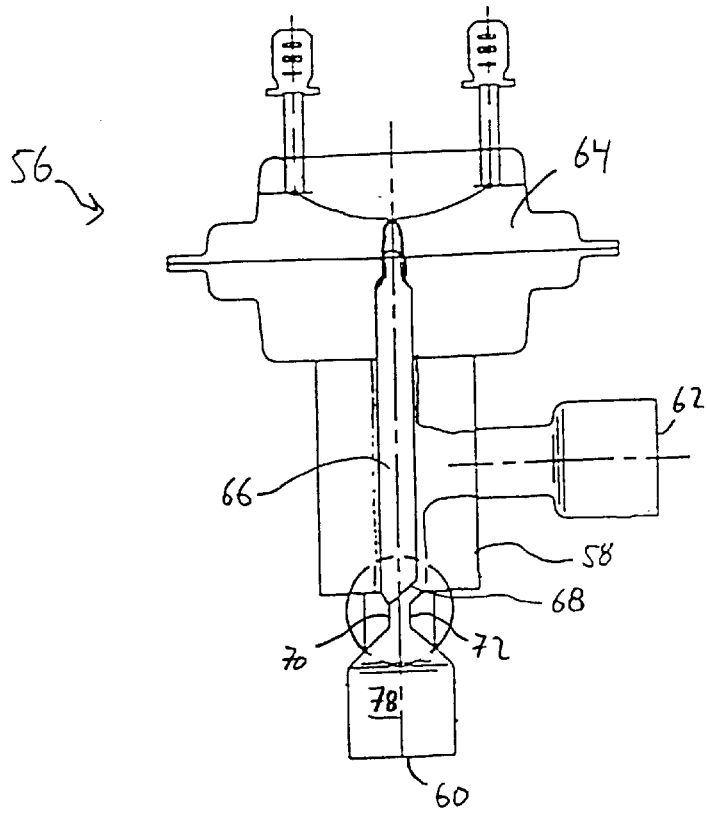
FIG. 3 is a cross-sectional view of a metering device according to the present invention.

As illustrated in FIG. 2, a valve 56 is placed in an inlet suction line 52 leading to compressor 20. In a preferred embodiment, as illustrated in FIG. 3, valve 56 includes a housing 58 that defines an inlet 60, an outlet 62, and a flow path 78. A valve stem 66 is slidably mounted in housing 58 and has a face 68 disposed in fluid flow path 78.

Figure 4:
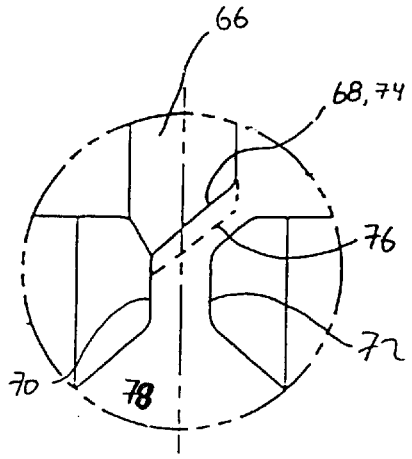
FIG. 4 is a partial cross-sectional view of the metering device of FIG. 3, illustrating a large orifice and a small orifice in accordance with the present invention

Walls 70 and 72 define fluid flow path 78. Walls 70 and 72 cooperate with face 68 of valve stem 66 to define an orifice through which fluid must flow to exit the valve. As illustrated in FIG. 4, valve stem 66 may be moved between a first position (represented by dashed line 76) and a second position 74. When valve stem 66 is in the first position 76, face 68 defines a small orifice through which the operating fluid must flow in order to reach outlet 62. Moving valve stem 66 to second position 74 creates a large orifice that allows a greater amount of fluid to flow to fluid outlet 62. In this manner, valve 56 meters the flow of fluid between a first flow rate as defined by the large orifice and a second flow rate as defined by the small orifice.

Preferably, face 68 is angled with respect to the direction of fluid flow and a portion of valve stem 66 is supported by wall 70. The angled configuration of face 68 reduces the force required to return the valve stem 66 to the first position from the second position. The engagement of valve stem 66 with wall 70 will ensure that valve stem does not deflect in response to the force of the fluid on angled face 68, thereby ensuring the size of the defined orifice will remain constant.

The size of the orifices defined by walls 70 and 72 and face 68 are configured to correspond to the operating capacities of the compressor. The size of the large orifice is configured to allow a flow rate of fluid that will optimize the efficiency of the conditioning system when the compressor operates at full capacity. The size of the small orifice is similarly configured to allow a flow rate of fluid that will optimize the efficiency of the conditioning system when the compressor operates at the reduced capacity.

Preferably, the amount of reduction in flow rate is directly proportional to the reduction in operating capacity. Because the thermodynamic characteristics of the operating fluid dictate the optimal compressed pressure of the operating fluid, the most efficient use of the reduced capacity of the compressor is to compress a smaller amount of fluid to the optimal pressure. So, for example, if the operating capacity of the compressor is reduced to 66% of the full capacity, the amount of operating fluid flow through the system should similarly be reduced to 66% of the full capacity.

Preferably, as illustrated in FIG. 3, valve 56 includes a solenoid 64. Solenoid 64 is connected to valve stem 66. Energizing solenoid 64 causes valve stem 66 to move from the first position to the second position to increase the flow rate of fluid through the flow path 78. The present invention contemplates that the solenoid may be energized to decrease the flow rate of fluid. However, it is preferable to have the unenergized state of the solenoid correspond with the small orifice so that in the case of a power failure, where the solenoid will return to the un-energized position, the fluid pathway will be restricted to the small orifice. This will ensure no fluid in liquid form will return to the compressor. For example, if the solenoid stayed energized and the compressor was running at low capacity (66%) the large orifice would be exposed and would allow fluid in its liquid state to enter the compressor. Restricting the pathway to the small orifice will only allow fluid in its vapor state to enter the compressor in full capacity or at reduced capacity.

Referring to FIG. 2, control 50 is connected to valve 56. Control 50 governs the location of valve stem 66 depending on the operating capacity of the compressor. When sensor 54 indicates that compressor 20 should operate at high capacity, control 50 ensures that crankshaft 22 is rotated in the forward direction to run at full capacity and that solenoid 64 of valve 56 is energized to move valve stem 66 to the second position to create the large orifice. When sensor 54 indicates that compressor should operate at the low capacity, control 50 ensures crankshaft is rotated in the reverse direction and de-energizes solenoid 64 to move valve stem 66 to the first position to create the small orifice.

The present invention also contemplates that a variety of other devices may be used to move the valve stem from the first position to the second position, such as, for example, lead screws, stepper motors, or pneumatic systems. However, to reduce the complexity of the control, the valve stem should be moveable between two positions to create two differently sized orifices.

Figure 5:
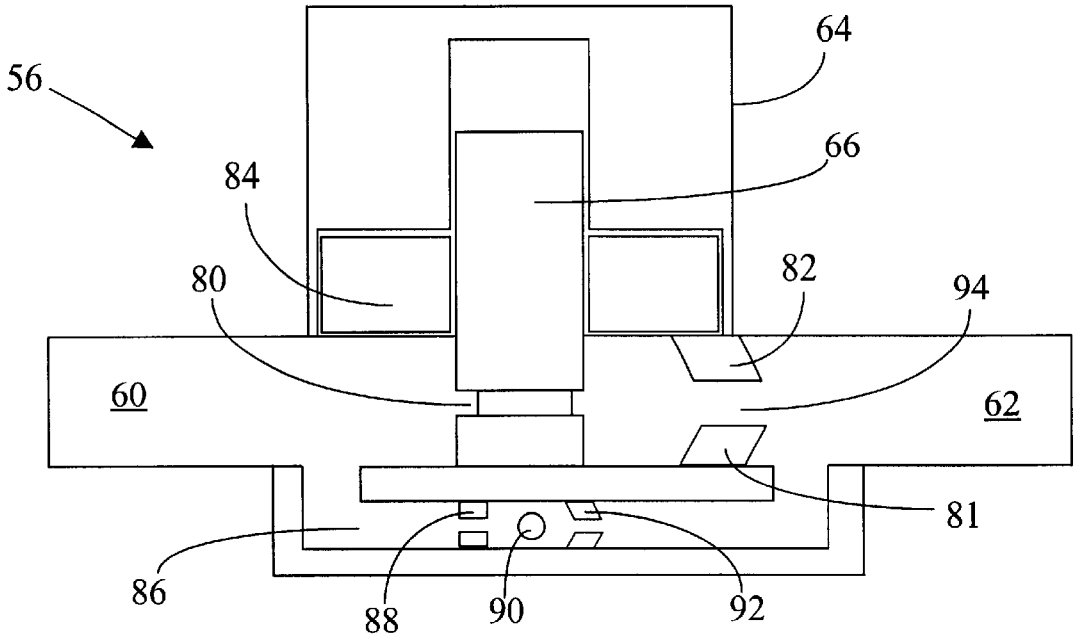
FIG. 5 is a cross-sectional view of another embodiment of a metering device according to the present invention, illustrating fluid flow through a small orifice.
Figure 6:
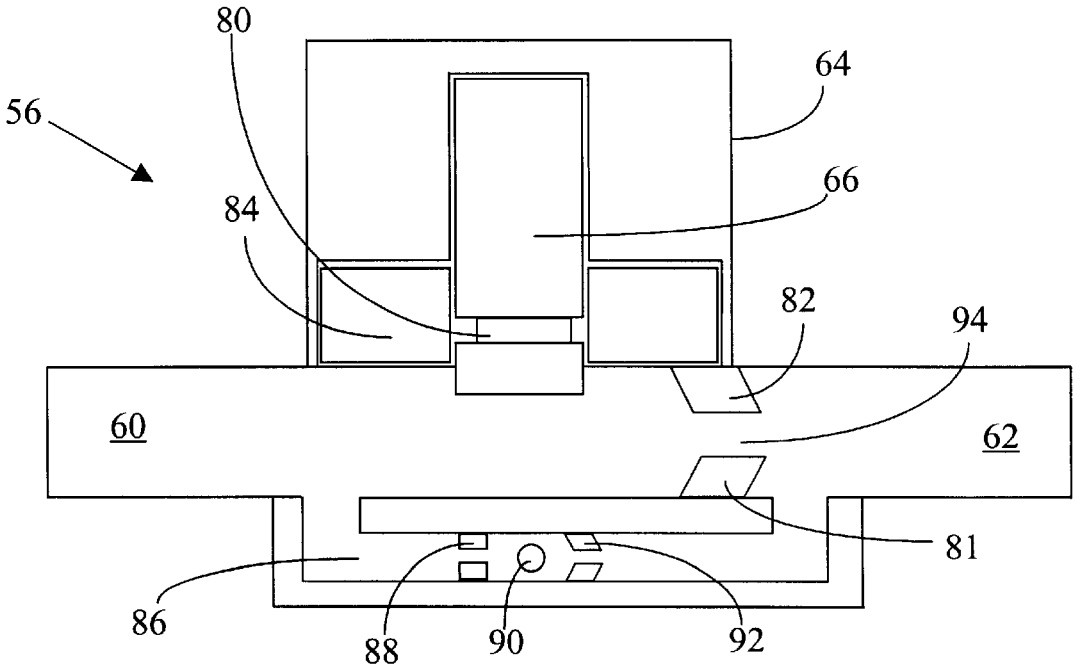
FIG. 6 is a cross-sectional view of the metering device of FIG. 5, illustrating fluid flow through a large orifice.

Another embodiment of a valve according to the present invention is illustrated in FIGS. 5 and 6. In this embodiment, valve stem 66 includes an internal passageway 80 that defines the small orifice. The valve 56 includes a wall 82 that defines the large orifice 94. When, as illustrated in FIG. 5, valve stem 66 is in the first position, valve stem 66 blocks the flow of fluid, with the exception of passageway 80. Thus, fluid must flow through the small orifice to reach outlet 62.

As illustrated in FIG. 6, energizing magnet 84 of solenoid 64 moves valve stem 66 to the second position. In this position, fluid flows freely from inlet 60 to wall 82, which directs fluid through the large orifice 94. Thus, moving the valve stem to the second position removes the flow restriction of the small orifice and the fluid flow rate increases according to the large orifice.

As also shown in FIG. 5, valve 56 may include a bypass 86. Bypass 86 includes a check ball 90 disposed between seats 88 and 92. The present invention contemplates that the metering device of the present invention may be used with a reversible heat pump. When the system is operating in the cooling mode, check ball 90 will engage seat 92 to prevent fluid flow through bypass 86. When the system is reversed to operate in the heating mode, check ball 90 will move against seat 88, which is configured to allow fluid to flow around check ball 90. Thus, valve 56 will not restrict the flow of refrigerant when the system is operating in the heating mode. It is contemplated that a bypass may be provided in each embodiment of the valve of the present invention.

Figure 7:
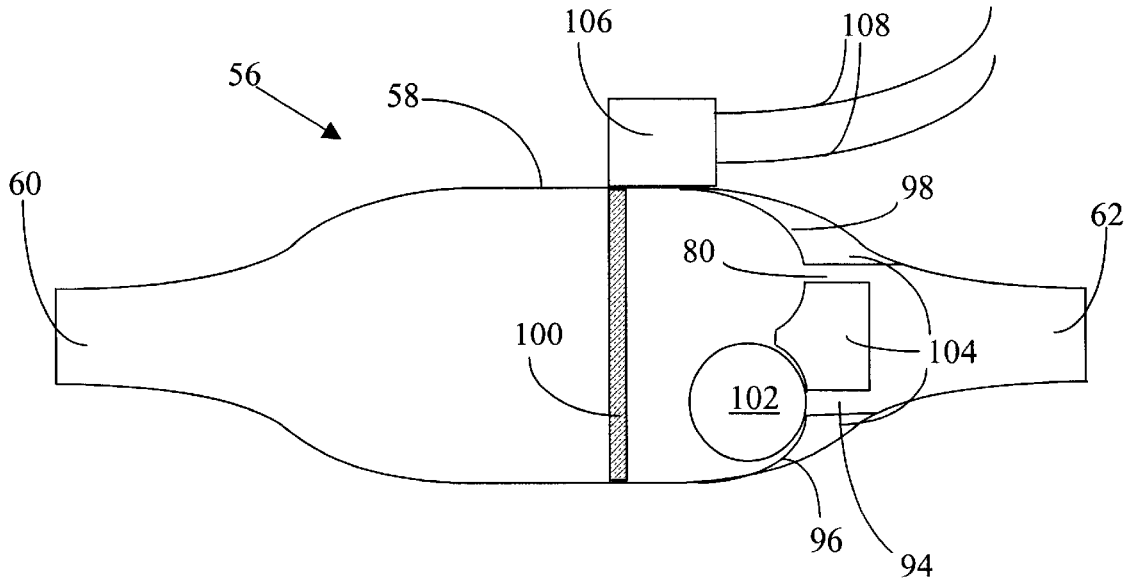
FIG. 7 is a cross-sectional view of another embodiment of a metering device according to the present invention, illustrating fluid flow through a small orifice.
Figure 8:
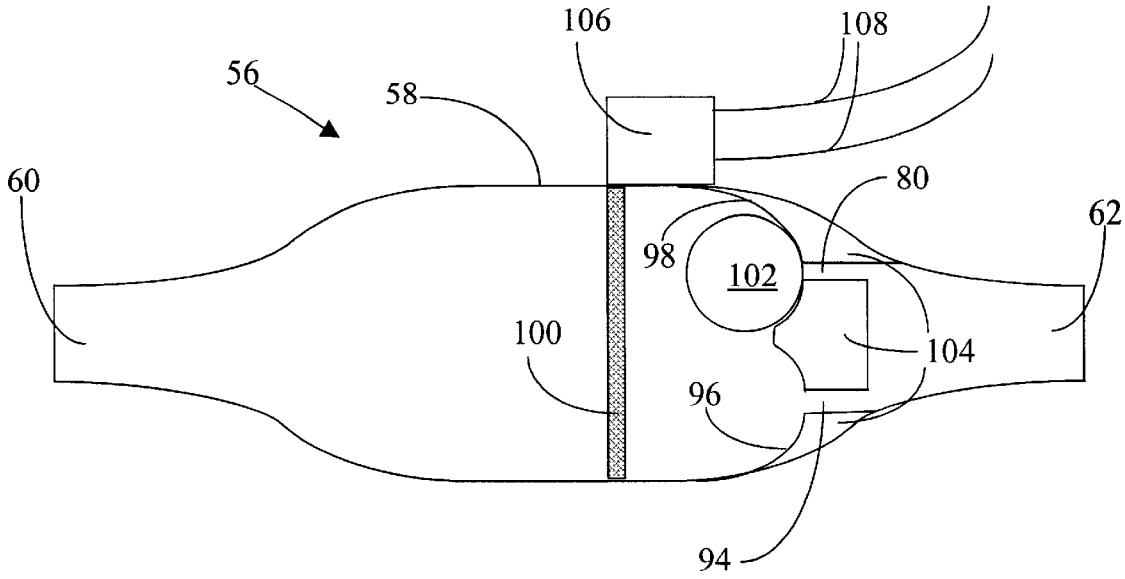
FIG. 8 is a cross-sectional view of the metering device of FIG. 7, illustrating fluid flow through a large orifice.

Still another embodiment of a valve according to the present invention is illustrated in FIGS. 7 and 8. In this embodiment, valve 56 includes a check ball 102 and a wall 104 that defines large orifice 94 and small orifice 80. Wall 104 also defines a seat 96 and 98 around the entrance to each orifice. Seats 96 and 98 are configured to receive check ball 102 so that when check ball 102 is disposed in one of the seats, check ball prevents fluid from flowing through the respective orifice. The flow of fluid through the valve acts on check ball 102 to force the check ball into sealing engagement with the respective seat. For example, as illustrated in FIG. 7, when check ball 102 is disposed in seat 96, the force of the fluid on the check ball seals large orifice 94, and fluid must flow through small orifice 80 to exit valve 56.

Preferably, an electromagnet 106 is provided in connection with control 50 through wires 108. When magnet 106 is energized, the magnet attracts check ball 102, which is preferably made of a magnetically attractable material, and moves check ball 102 towards seat 98. The force of the fluid acting on check ball 102 will force check ball 102 into seat 98 and block small orifice 80. Thus, when magnet 106 is energized, the fluid flow rate is controlled by the size of large orifice 96. Similarly, de-energization of magnet allows gravity to act on check ball 102 to move the check ball back to seat 96.

Preferably, a mesh screen 100 is disposed in valve housing 58. Screen 100 ensures check ball 102 stays in close proximity to seats 96 and 98. If fluid is not flowing through valve 56, check ball 102 will tend to move away from wall 104 until contacting screen 100. When fluid starts to flow through valve 56, the force of the fluid on the check ball will move the check ball into contact with seat 96. Preferably, the exterior of housing includes markings to indicate which side of the housing must be above the other to ensure proper operation of the valve.

Figure 9:
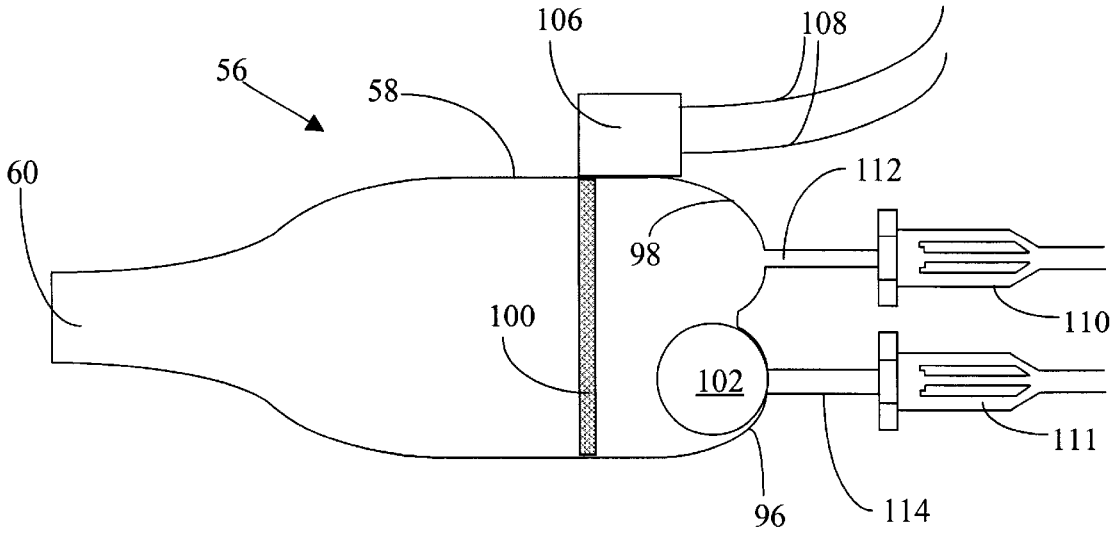
FIG. 9 is a cross-sectional view of another embodiment of a metering device according to the present invention, illustrating fluid flow through the small orifice.

Alternatively, as illustrated in FIG. 9, valve 56 may include separate passageways 112 and 114 emanating from seats 98 and 96. Passageways 112 and 114 may be sized such that passageway 112 acts as the small orifice and passageway 114 acts as the large orifice. Magnet 106 may be energized to move check ball 102 from seat 96 to seat 98 to direct the fluid through the large passageway 114 or remain un-energized so that fluid is directed through the small passageway 112.

In another alternative embodiment, passageways 112 and 114 may have essentially the same diameter. The large and small orifices are defined by a pair of valve flutes 110 and 11 that are engageable with each passageway 112 and 114. Valve flute 110 is configured to define the small orifice and valve flute 111 is configured to define the large orifice. This embodiment allows the size of the large and small orifices to be easily changed by simply engaging a differently configured valve flute with the respective passageway. Thus, the basic valve body may be used with any sized compressor and only the valve flutes need be adjusted to optimize the efficiency of the compressor.

The operation of a preferred embodiment of the aforementioned system will now be described with reference to the attached drawings. As illustrated in FIG. 2, sensor 54 senses the condition of the air within space 55 and transmits a corresponding signal to control 50. Control 50 governs the operation of compressor 20 according to the demand. If the demand is high, control 50 induces a forward rotation of crankshaft 22 (referring to FIG. 1) in compressor 20 to operate the compressor at the high capacity. Control 50 also moves valve stem 66 (referring to FIGS. 3 and 4) in valve 56 to the second position 74 to form a large orifice in the valve. The large orifice allows operating fluid to flow to the compressor at a rate corresponding to the high operating capacity.

When the sensed condition of space 55 indicates a lower demand, control 50 reverses the rotational direction of crankshaft 22 to operate the compressor at the reduced capacity. In addition, control 50 de-energizes solenoid 64 to return valve stem 66 to the first position and form the small orifice. This restricts the fluid flow rate to a rate that corresponds to the reduced operating capacity of the compressor.

The present invention, therefore, provides a two-step metering device for a variable capacity compressor that improves the overall efficiency of the compressor. In addition, the metering device is simple to control and relatively inexpensive to manufacture.

It will be apparent to those skilled in the art that various modifications and variations can be made in the system for metering flow to a variable capacity compressor without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A metering device for controlling the flow of an operating fluid to a variable capacity compressor, the compressor operable at a high operating capacity and a reduced operating capacity, the device comprising:

a valve defining a fluid flow path for controlling the flow rate of the operating fluid to the compressor, the fluid flow path including a large orifice configured to allow a flow rate corresponding to the high operating capacity of the compressor and a small orifice configured to allow a flow rate corresponding to the reduced operating capacity of the compressor; and a control operable to adjust the valve to direct the operating fluid through the large orifice when the compressor is operating at the high capacity and to direct fluid through the small orifice when the compressor is operating at the reduced capacity.

2. The device of claim 1, wherein the valve includes a valve stem disposed in the fluid flow path, the valve stem moveable from a first position where the valve stem defines the small orifice and a second position where the valve stem defines the large orifice.

3. The device of claim 2, further comprising a solenoid operable to move the valve stem between the first position and the second position when the operating capacity of the compressor changes between the reduced operating capacity and the high operating capacity.

4. The device of claim 1, wherein the difference in size between the large orifice and the small orifice is directly proportional to the reduction in operating capacity of the compressor between the high operating capacity and the reduced operating capacity.

5. A system for conditioning air in a space, comprising:

a sensor operable to sense the condition of the space;

a compressor operable to compress an operating fluid at a preselected, constant high capacity and a preselected, constant reduced capacity;

a valve for controlling the flow rate of the operating fluid to the compressor, the valve including a large orifice configured to allow a flow rate corresponding to the high capacity of the compressor and a small orifice configured to allow a flow rate corresponding to the reduced capacity of the compressor; and a control operable to run the compressor at one of the first and second operating capacities depending upon the sensed condition of the space, the control further operable to adjust the valve to direct the operating fluid through the large orifice when the compressor is operating at the high capacity and to direct fluid through the small orifice when the compressor is operating at the reduced capacity.

6. The system of claim 5, wherein the compressor is a reciprocating compressor having a reversible shaft, the compressor operating at the high capacity when the shaft rotates in the forward direction and at the reduced capacity when the shaft rotates in the reverse direction.

7. The system of claim 5, wherein the valve includes a valve stem disposed in the fluid flow path, the valve stem moveable from a first position where the valve stem defines the large orifice and a second position where the valve stem defines the small orifice.

8. The system of claim 7, further comprising a solenoid operable to move the valve stem between the first and second positions.

9. The system of claim 5, wherein the reduction in size between the large orifice and the small orifice is directly proportional to the reduction in operating capacity of the compressor between the reduced capacity and the high capacity.

10. The device of claim 9, further comprising a by-pass check valve.

11. The device of claim 9, further comprising a solenoid operable to move the valve stem from the first position to the second position.

12. A system for conditioning air in a space, comprising:

a sensor operable to sense the condition of the space;

a compressor operable to compress an operating fluid at a preselected, constant high capacity and a preselected, constant reduced capacity;

a valve for controlling the flow rate of the operating fluid to the compressor, the valve including a large orifice configured to allow a flow rate corresponding to the high capacitiy of the compressor and a small orifice configured to allow a flow rate corresponding to the reduced capacity of the compressor; and a control operable to run the compressor at one of the first and second operating capacities depending upon the sensed condition of the space, the control further operable to adjust the valve to direct the operating fluid through the large orifice when the compressor is operating at the high capacity and to direct fluid through the small orifice when the compressor is operating at the reduced capacity.

13. The system of claim 12, wherein the compressor is a reciprocating compressor having a reversible shaft, the compressor operating at the high capacity when the shaft rotates in the forward direction and at the reduced capacity when the shaft rotates in the reverse direction.

14. The system of claim 12, wherein the valve includes a valve stem disposed in the fluid flow path, the valve stem moveable from a first position where the valve stem defines the large orifice and a second position where the valve stem defines the small orifice.

15. The system of claim 14, further comprising a solenoid operable to move the valve stem between the first and second positions.

16. The system of claim 12, wherein the reduction in size between the large orifice and the small orifice is directly proportional to the reduction in operating capacity of the compressor between the reduced capacity and the high capacity.

17. The system of claim 12, wherein the valve includes a wall separating the large orifice from the small orifice.

18. The system of claim 17, wherein the valve includes a first curved surface adjacent the large orifice, a second curved surface adjacent the small orifice, and a check ball configured to engage one of the first and second curved surfaces to prevent the operating fluid from flowing through one of the first and small orifices.

19. The system of claim 18, further comprising a magnet operable to move the check ball from the one of the curved surfaces to the other of the curved surfaces.

20. The system of claim 18, further comprising a mechanical surface configured to retain the check ball adjacent the curved surfaces.

21. The system of claim 12, wherein the valve includes a valve stem having an internal passageway defining the large orifice and the valve includes a wall defining the small orifice, the valve stem movable between a first position where the operating fluid is directed through both the large orifice and the small orifice and a second position where the operating fluid is directed through the small orifice.

22. The system of claim 21, further comprising a by-pass check valve.

23. The system of claim 21, further comprising a solenoid operable to move the valve stem from the first position to the second position.

* * * * *

UNITED STATES PATENT AND TRADEMARK OFFICE

CERTIFICATE OF CORRECTION

PATENT NO. : 6,276,154 B1
DATED : August 21, 2001
INVENTOR(S) : Larry Pippin

It is certified that error appears in the above-identified patent and that said Letters Patent is hereby corrected as shown below:

Column 8, line 33, to Column 9, line 3,
In their entirety and insert

5. The device of claim 1, wherein the valve includes a wall separating the large orifice from the small orifice.

6. The device of claim 5, wherein the valve includes a first curved surface adjacent the large orifice, a second curved surface adjacent the small orifice, and a check ball configured to engage one of the first and second curved surfaces to prevent the operating fluid flowing through one of the large and small orifices.

7. The device of claim 6, further comprising a magnet operable to move the check ball from one of the curved surfaces to the other of the curved surfaces.

8. The device of claim 6, further comprising a mechanical surface configured to retain the check ball adjacent the curved surfaces.

9. The device of claim 1, wherein the valve includes a valve stem having an internal passageway defining the small orifice and the valve includes a wall defining the large orifice, the valve stem moveable between a first position where the operating fluid is directed through the small orifice and then through the large orifice and a second position where the operating fluid is directed through the large orifice.

Signed and Sealed this

Second Day of July, 2002

*Attest:*

*Attesting Officer*

JAMES E. ROGAN
*Director of the United States Patent and Trademark Office*